US009333770B2

(12) United States Patent
Murata

(10) Patent No.: US 9,333,770 B2
(45) Date of Patent: May 10, 2016

(54) PRINTING UNIT AND PRINTER

(71) Applicant: Seiko Instruments Inc., Chiba-shi, Chiba (JP)

(72) Inventor: Tomohiro Murata, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 0 days.

(21) Appl. No.: 14/865,973

(22) Filed: Sep. 25, 2015

(65) Prior Publication Data

US 2016/0089907 A1 Mar. 31, 2016

(30) Foreign Application Priority Data

Sep. 30, 2014 (JP) ..... 2014-202019
Mar. 18, 2015 (JP) ..... 2015-055157

(51) Int. Cl.
*B41J 15/16* (2006.01)
*B41J 11/04* (2006.01)
*B41J 2/32* (2006.01)

(52) U.S. Cl.
CPC ... *B41J 11/04* (2013.01); *B41J 2/32* (2013.01)

(58) Field of Classification Search
CPC ..... B41J 29/393; B41J 2/14274; B41J 2/14; B41J 2/145; B41J 2/14145; B41J 2/1433; B41J 2/1621; B41J 2/164
See application file for complete search history.

(56) References Cited

U.S. PATENT DOCUMENTS 7,740,348 B2 * 6/2010 Miyashita ..... B41J 13/14 347/101
8,690,315 B2 * 4/2014 Horade ..... B41J 11/485 347/104
8,991,967 B2 * 3/2015 Tokushima ..... B41J 15/16 347/16

FOREIGN PATENT DOCUMENTS

JP 9-216394 A 8/1997

* cited by examiner

*Primary Examiner* — Lamson Nguyen
(74) *Attorney, Agent, or Firm* — Brinks Gilson & Lione

(57) ABSTRACT

A printing unit comprises: a head unit including a head block having a thermal head provided therein; a platen unit including a platen roller configured to feed a recording sheet, the platen unit being separably combined with the head unit, wherein the head unit includes: a head frame including the head block removably mounted thereon, the head frame being configured to support the head block so that the head block is pivotable in a direction approaching and separating from the platen roller; an urging member interposed between the head frame and the head block, the urging member being configured to urge the thermal head toward the platen roller; a cutter mechanism mounted onto the head frame so as to be removable therefrom; and lock portions locked to the head block, which are configured to restrict a pivot of the head block toward the platen roller.

8 Claims, 13 Drawing Sheets

PRINTING UNIT AND PRINTER

RELATED APPLICATIONS

This application claims priority under 35 U.S.C. §119 to Japanese Patent Application No. 2014-202019 filed on Sep. 30, 2014 and No. 2015-055157 filed on Mar. 18, 2015, the entire contents of which are hereby incorporated by reference.

BACKGROUND OF THE INVENTION

1. Field of the Invention

The present invention relates to a printing unit and a printer.

2. Description of the Related Art

Hitherto, a thermal printer has been known as a printer for printing on a recording sheet (heat-sensitive paper). The thermal printer includes a printing unit that can be reduced in size and weight, and has a simple configuration without using toner or ink. Therefore, the thermal printer is employed for cash registers or mobile terminal devices to be widely used to print various labels, receipts, and tickets.

As the printing unit described above, a so-called "separate-type" printing unit is known. In the separate-type printing unit, for example, a head frame for supporting a thermal head is mounted to a casing main body for receiving a roll sheet therein, whereas a platen frame for supporting a platen roller is mounted to a printer cover that is coupled to the casing main body so that the printer cover can be operated to be opened and closed.

The above-mentioned thermal head is supported on the head frame so as to be pivotable and is urged toward the platen roller by an urging member. With this configuration, a pressure-contact state between the platen roller and the thermal head is maintained when the printer cover is located at a closed position. On the other hand, a pivot of the thermal head toward the platen roller is regulated by a regulating portion provided to the head frame. With the regulating portion, the thermal head is positioned with respect to the head frame when the printer cover is located at an opened position.

As the above-mentioned type of thermal printers, the following thermal printer is known. Specifically, when a failure occurs in the thermal head due to wear between the thermal head and the platen roller or the like, the thermal head can be removed from the head frame to be replaced. According to this configuration, in case of failure of the thermal head, replacement work can be carried out at lower costs as compared with, for example, a case where the whole printing unit is replaced.

In the related art described above, the regulating portion for regulating the movement of the thermal head toward the platen roller is provided to the head frame, and hence it is difficult to pull out the thermal head from the platen roller side. Specifically, in order to remove the thermal head, the thermal head is inevitably required to be pulled out from a side opposite to the platen roller side. In this case, a replacement space for allowing the thermal head (head support member) to pass therethrough for the replacement is required to be ensured in a portion inside the head frame, which is located on the side opposite to the platen roller side with respect to the thermal head. Therefore, a component (such as a motor) cannot be placed in the replacement space, and hence there is a problem of a low degree of freedom in design, which leads to increased size of a product.

In view of the above-mentioned matters, a printing unit and a printer, each including a thermal head that is easily removable, capable of being downsized and improving a degree of freedom in design have been demanded in this field of art.

SUMMARY OF THE INVENTION

According to one embodiment of the present invention, there is provided a printing unit, including: a head unit including a head block having a thermal head provided therein; a platen unit including a platen roller configured to feed a recording sheet, the platen unit being separably combined with the head unit, a head frame including the head block removably mounted thereon, the head frame being configured to support the head block so that the head block is pivotable in a direction approaching and separating from the platen roller; an urging member interposed between the head frame and the head block, the urging member being configured to urge the thermal head toward the platen roller; a cutter mechanism mounted onto the head frame so as to be removable therefrom; and lock portions to be locked to the head block, which are configured to restrict a pivot of the head block toward the platen roller.

According to this configuration, when the cutter mechanism is removed from the head frame and the lock portions and the head block are disengaged from each other, the restriction of the pivot of the head block toward the platen roller is cancelled. In this manner, during work of replacing the head block, for example, the head block may be pulled out toward the platen roller. In this case, the replacement space for the head block, which is set in the head frame on the side opposite to the platen roller side with respect to the head block, may be minimized. Therefore, a degree of freedom in design within the head frame is improved in that, for example, a component may be placed in the space on the side opposite to the platen roller side with respect to the head block. As a result, a product may be downsized. Further, the work of replacing the head block may be performed only by removing the cutter mechanism that is removable from the head frame. Therefore, the replacement work may be improved in efficiency and reduced in costs. In addition, the lock portions are provided to the existing cutter mechanism, and therefore the increase in number of components due to the formation of the lock portions may be prevented.

In the printing unit according to the one embodiment of the present invention, the lock portions are provided so as to extend in a direction in which the cutter mechanism is mounted and removed, and the head block includes slits into which the lock portions are freely inserted along the direction in which the cutter mechanism is mounted and removed.

According to this configuration, the lock portions are provided so as to extend along the direction in which the cutter mechanism is mounted and removed. Therefore, a state of the lock portions and the head block may be switched between a locked state and an unlocked state along with the operation of mounting and removing the cutter mechanism. Thus, operability may be further improved.

In the printing unit according to the one embodiment of the present invention, the head block is configured to be pulled out toward the platen roller to be removed under a state in which the cutter mechanism is removed from the head frame.

According to this configuration, the head block may be pulled out toward the platen roller to be removed. Therefore, as described above, the replacement space for the head block, which is set in the head frame on the side opposite to the platen roller side with respect to the head block, may be minimized.

In the printing unit according to the one embodiment of the present invention, the head block includes receiving concave portions being open toward the platen roller, which are configured to receive a pivot shaft of the head frame therein.

According to this configuration, in contrast to a case where, for example, the pivot shaft is inserted into through holes of the head block, the head block and the pivot shaft may be easily uncoupled from each other only by moving the head block in a direction in which the pivot shaft is removed from the receiving concave portions. In this manner, the operability may be further improved.

According to one embodiment of the present invention, there is provided a printer, including the above-mentioned printing unit according to the present invention, in which the head unit is mounted to a casing main body including a recording-sheet receiving portion configured to receive the recording sheet, whereas the platen unit is mounted to a printer cover to be pivotably coupled to the casing main body through intermediation of a hinge portion, the printer cover being configured to open and close the recording-sheet receiving portion.

According to this configuration, the printer includes the printing unit described above. Therefore, excellent operability may be provided while downsizing and improvement of a degree of freedom in design are achieved.

As described above, according to the printing unit and the printer of the one embodiment of the present invention, the thermal head may be easily mounted and removed while the downsizing and the improvement of the degree of freedom in design are achieved.

DETAILED DESCRIPTION OF THE PREFERRED EMBODIMENTS

Embodiments of the present invention are now described referring to the accompanying drawings.

First Embodiment

Figure 1:
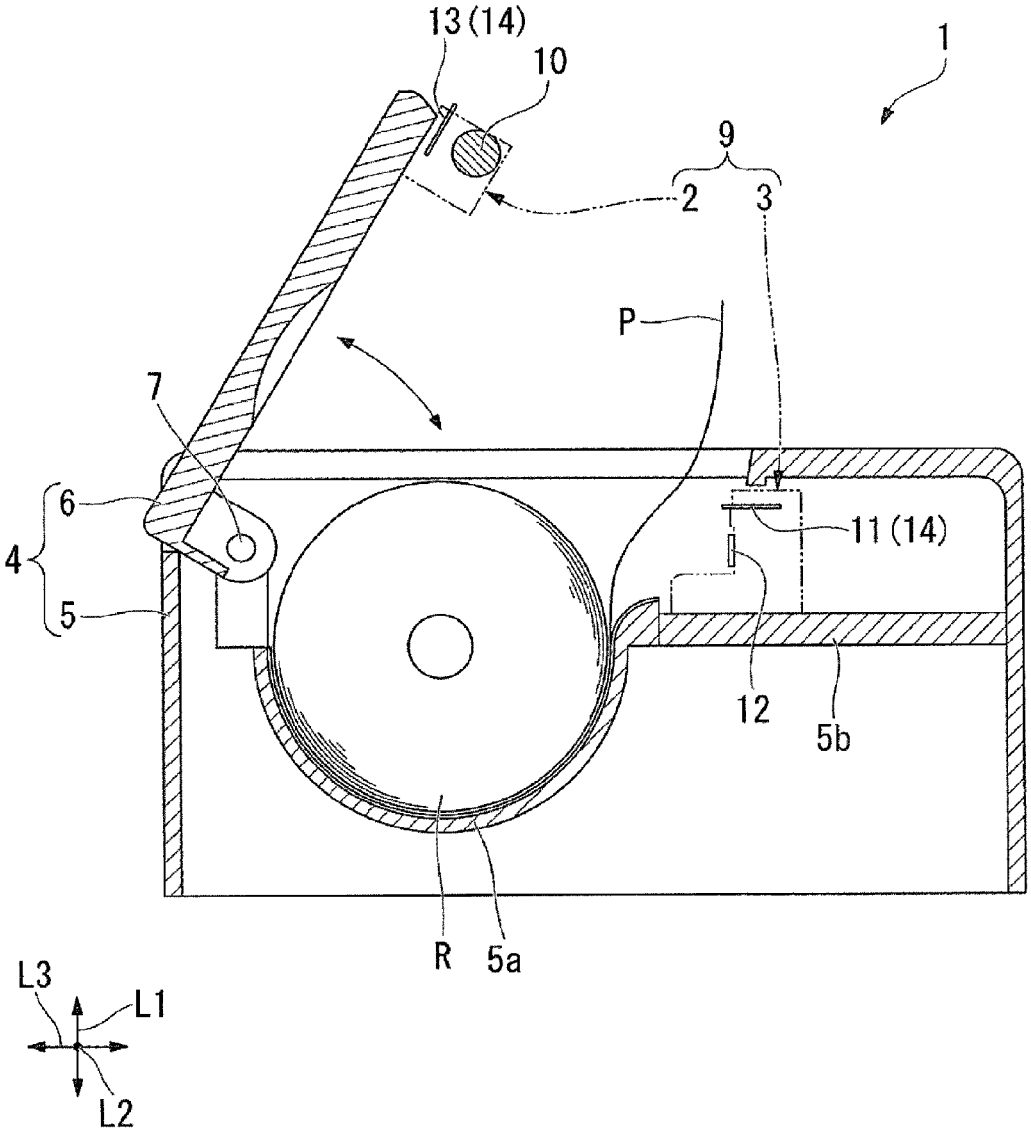
FIG. 1 is a sectional view of a thermal printer, for illustrating a state in which a printing unit is incorporated into a casing when a printer cover is located at an opened position.
Figure 2:
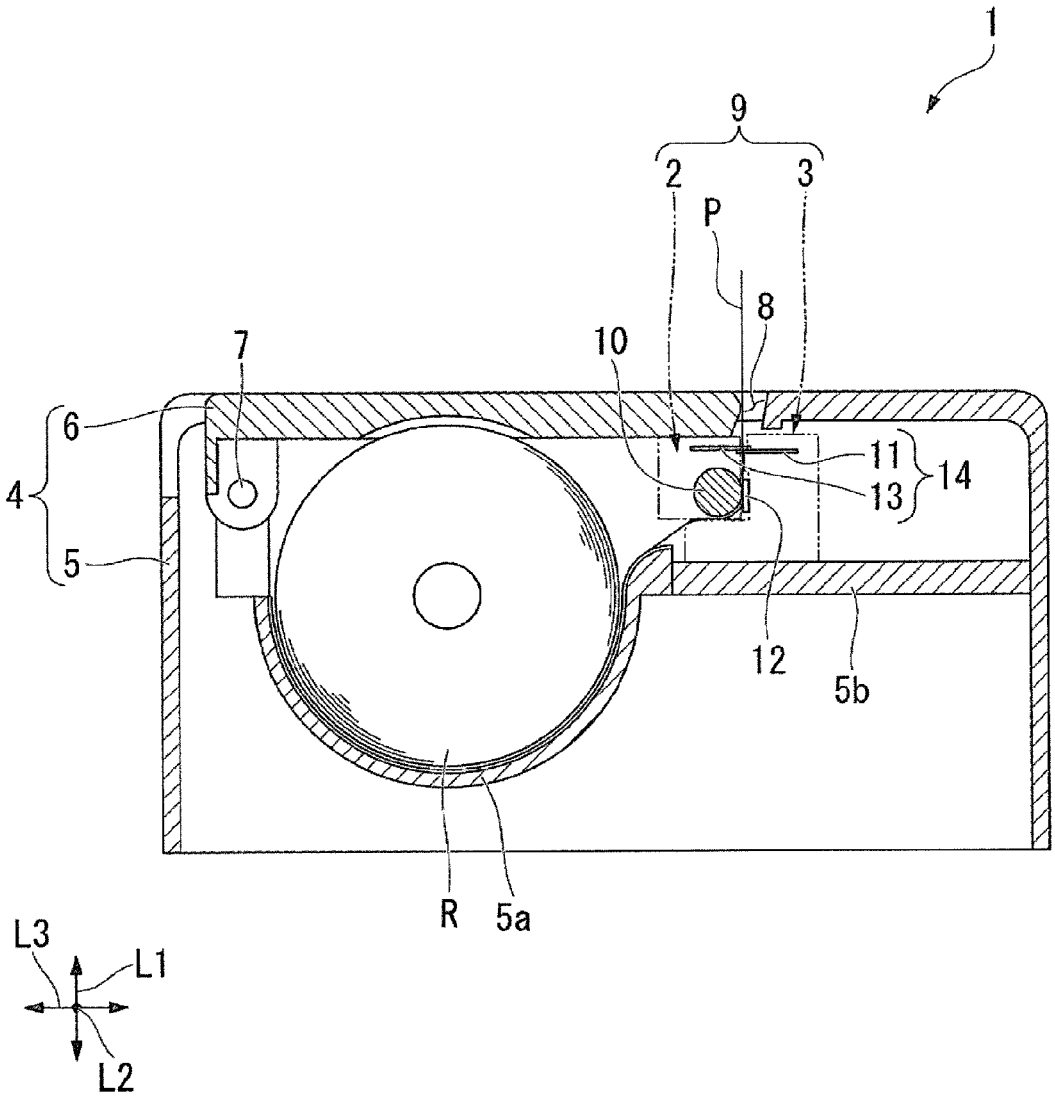
FIG. 2 is a sectional view of the thermal printer, for illustrating a state in which the printing unit is incorporated into the casing when the printer cover is located at a closed position.

FIG. 1 and FIG. 2 are sectional views of a thermal printer 1. FIG. 1 is an illustration of a state in which a printer cover 6 is located at an opened position, whereas FIG. 2 is an illustration of a state in which the printer cover 6 is located at a closed position (mounting position). In this embodiment, in an example illustrated in FIG. 1, a vertical direction in the drawing sheet is simply referred to as "vertical direction L1", a direction orthogonal to the drawing sheet is referred to as "horizontal direction L2", and a direction orthogonal to the vertical direction L1 and the horizontal direction L2 is referred to as "longitudinal direction L3". As illustrated in FIG. 1 and FIG. 2, the thermal printer 1 of this embodiment includes a printing unit 9 and a casing 4. The printing unit 9 includes a platen unit 2 and a head unit 3, which are combined with each other separably. The printing unit 9 is incorporated into the casing 4 that also receives a roll sheet R obtained by rolling a recording sheet P therein.

The casing 4 includes a casing main body 5 and a printer cover 6. The casing main body 5 includes a roll sheet receiving portion (recording sheet receiving portion) 5*a* for receiving the roll sheet R therein. The printer cover 6 opens and closes the roll sheet receiving portion 5*a*. The printer cover 6 is coupled pivotally to the casing main body 5 through intermediation of a hinge portion 7. Further, as illustrated in FIG. 2, a discharge port 8 for discharging the recording sheet P externally (upward) is formed between an opening edge of the roll sheet receiving portion 5*a* and a distal end portion of the printer cover 6 when the printer cover 6 is located at the closed position.

The platen unit 2 described above is a unit having a platen roller 10 and a fixed blade 13 mainly incorporated therein, and is mounted to an inner surface of a distal end portion of the printer cover 6. Therefore, through movement along with an opening and closing operation of the printer cover 6, the platen unit 2 is separably combined with the head unit 3. On the other hand, the head unit 3 is, for example, a unit having a thermal head 12 and a movable blade (cutter mechanism) 11 mainly incorporated therein, and is mounted to the casing main body 5. In the illustrated example, the head unit 3 is fixed on an inner plate 5*b* provided so as to be adjacent to the roll sheet receiving portion 5*a* so that the thermal head 12 is oriented toward the roll sheet receiving portion 5*a*.

When the printer cover 6 is closed to combine the platen unit 2 and the head unit 3 with each other, the thermal head 12 is pressed against the platen roller 10, as illustrated in FIG. 2. At the same time, the movable blade 11 partially overlaps the fixed blade 13. The fixed blade 13 and the movable blade 11 form a cutter unit 14.

Figure 3:
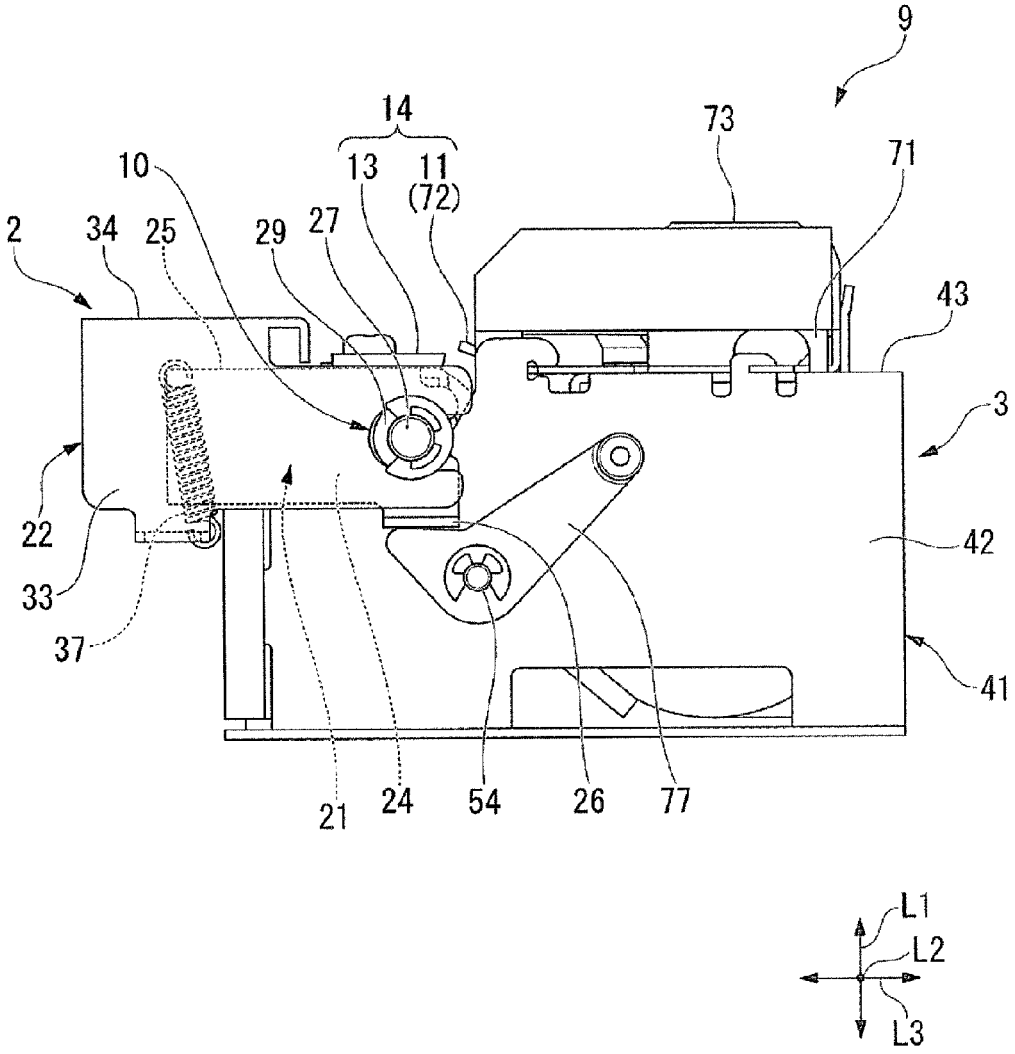
FIG. 3 is a side view of the printing unit according to a first embodiment of the present invention.
Figure 4:
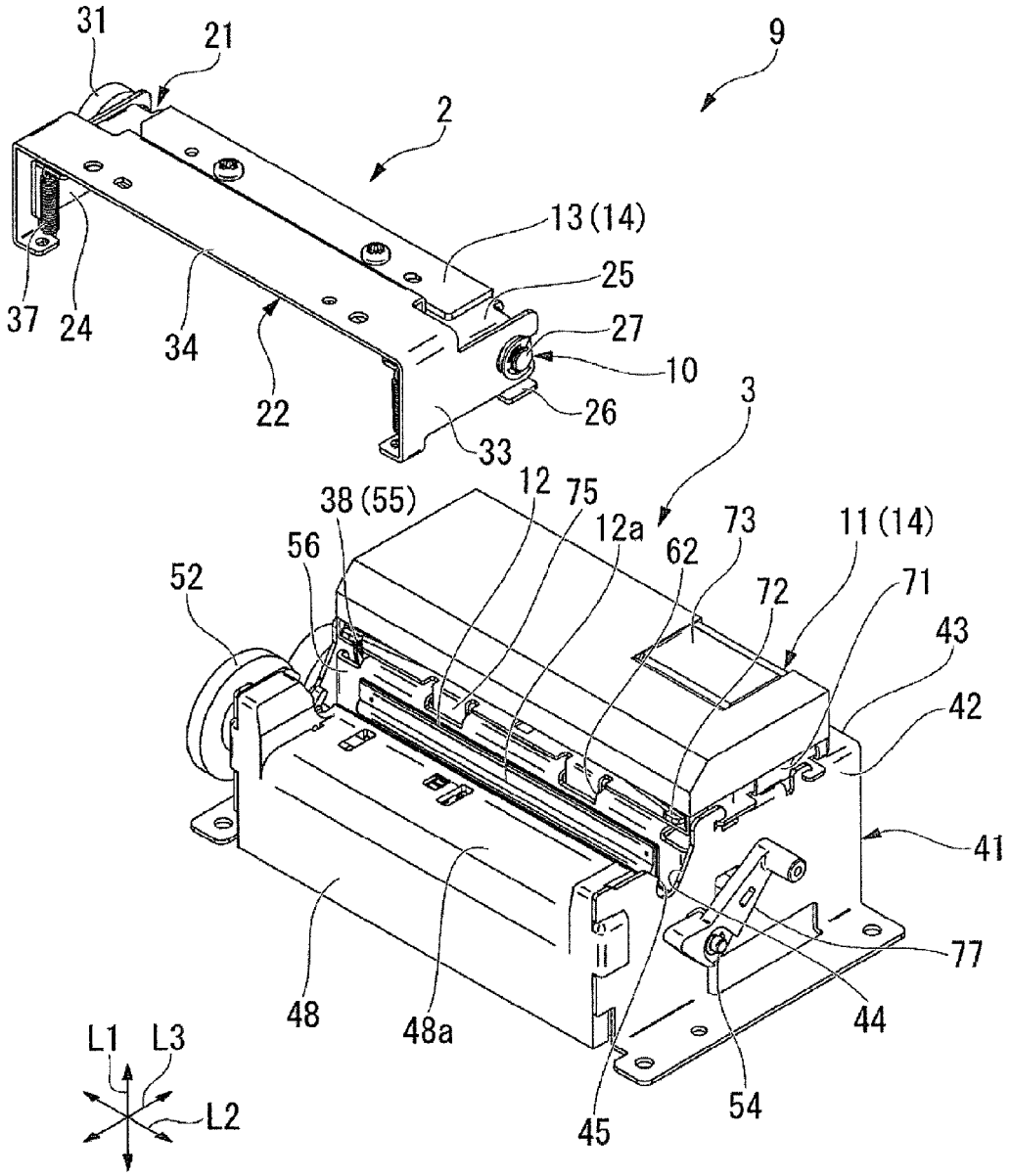
FIG. 4 is an exploded perspective view of the printing unit according to the first embodiment.
Figure 5:
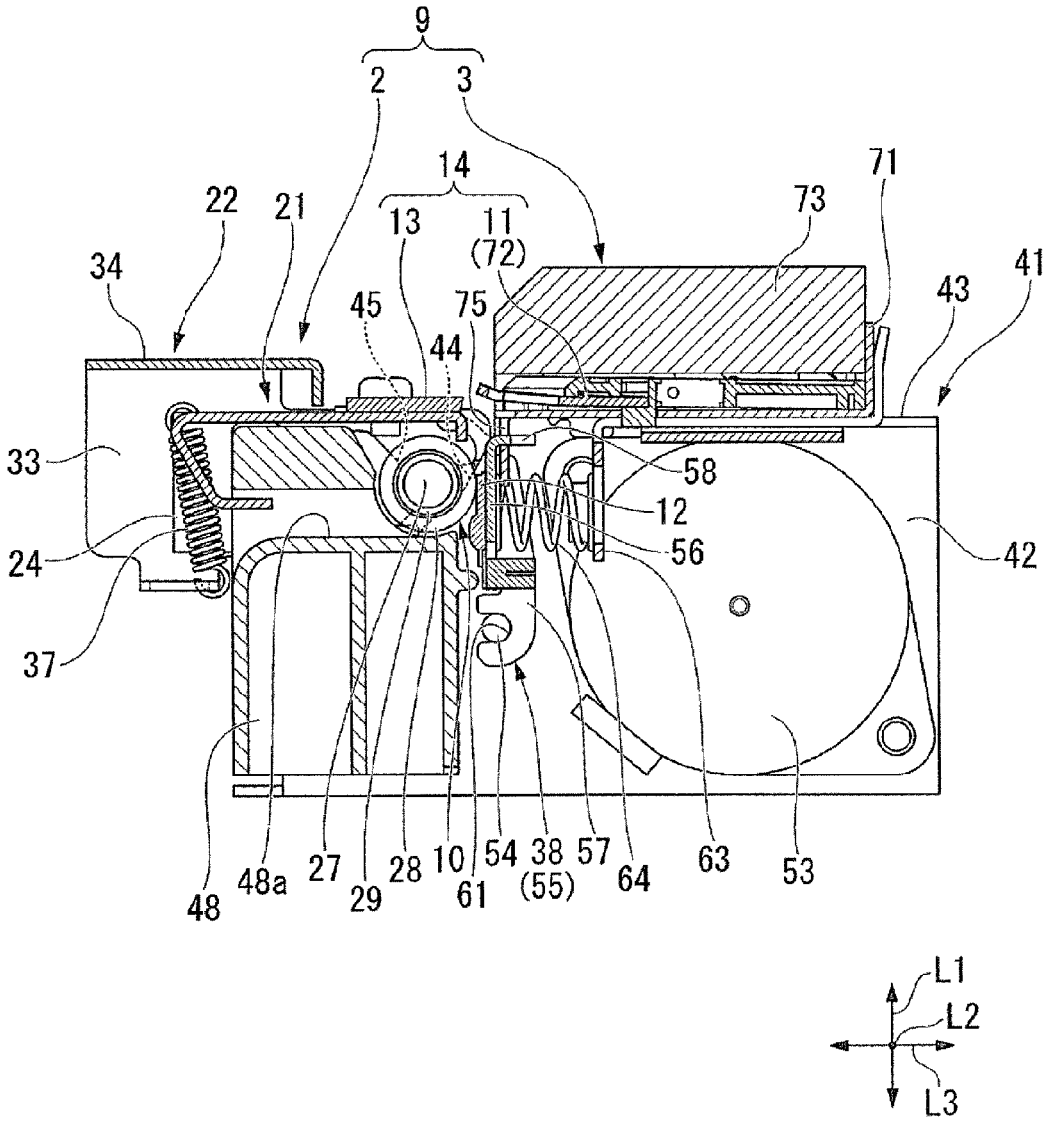
FIG. 5 is a sectional view of the printing unit according to the first embodiment.

FIG. 3 is a side view of the printing unit 9, and FIG. 4 is an exploded perspective view of the printing unit 9. FIG. 5 is a sectional view of the printing unit 9. As illustrated in FIG. 3 to FIG. 5, the platen unit 2 includes the platen roller 10 and the fixed blade 13, which are described above, a platen frame 21, and a subframe 22. The platen frame 21 supports the platen roller 10 and the fixed blade 13. The subframe 22 supports the platen frame 21.

First, the platen frame 21 is formed by bending a plate material made of a metal or the like, and has a U-like shape that is open downward in front view as viewed in the longitudinal direction L3. Specifically, the platen frame 21 includes a pair of shaft support portions 24 and a coupling portion 25. The shaft support portions 24 are respectively located on both end portions in the horizontal direction L2. The coupling portion 25 extends along the horizontal direction L2 and bridges the shaft support portions 24. A bearing 29 for the platen roller 10, which is described later, is held in one end portion (front end portion) of each of the shaft support portions 24 in the longitudinal direction L3. A projecting piece 26 that projects outward in the horizontal direction L2 is formed on a lower end portion of one of the shaft support portions 24, which is located on one end side in the horizontal direction L2.

The platen roller 10 is arranged so that an outer circumferential surface thereof comes into contact with the thermal head 12 under a state in which the recording sheet P is nipped between the platen unit 2 and the head unit 3 when the platen unit 2 and the head unit 3 are combined with each other while the printer cover 6 is in the closed position. Specifically, the platen roller 10 includes a platen shaft 27 and a roller main body 28. The platen shaft 27 extends along the horizontal direction L2. The roller main body 28 is made of a rubber or the like, and is mounted on the platen shaft 27.

The bearings 29 are respectively mounted on both end portions of the platen shaft 27. As described above, each of the bearings 29 is held by the platen frame 21. Through intermediation of the bearings 29, the platen roller 10 is rotatably supported by the platen frame 21. Further, a platen gear 31 is mounted on the other end portion of the platen shaft 27 (portion of the platen shaft 27, which is located on the outer side of the bearing 29 on the other end side in the horizontal direction L2) (see FIG. 4). In the following description, "one end side" in the horizontal direction L2 is defined as a side of the platen unit 2 in the horizontal direction L2 where the projecting piece 26 is provided, whereas "the other end side" in the horizontal direction L2 is defined as a side of the platen unit 2 in the horizontal direction L2, which is opposite to the "one end side", that is, the side where the platen gear 31 is mounted. When the platen unit 2 and the head unit 3 are combined with each other, the platen gear 31 comes into meshing engagement with a platen driving gear 52 (see FIG. 4) provided to the head unit 3, which is described later, to transmit a rotating force to the platen roller 10. In this manner, the recording sheet P can be fed while being nipped between the platen roller 10 and the thermal head 12.

The fixed blade 13 has a plate-like shape extending along the horizontal direction L2, and is fixed onto the coupling portion 25 of the platen frame 21 under a state in which a cutting edge of the fixed blade 13 is oriented to the front.

The subframe 22 is slightly larger than the platen frame 21, and surrounds the platen frame 21 on an upper side and both sides in the horizontal direction L2. Specifically, the subframe 22 includes side wall portions 33 and a base portion 34. The side wall portions 33 are located on both sides in the horizontal direction L2. The base portion 34 couples the side wall portions 33. Each of the bearings 29 for the platen roller 10 is inserted freely into a front end portion of corresponding one of the side wall portions 33.

Between the platen frame 21 and the subframe 22, a pair of pressure-applying mechanisms 37 for urging (applying a pressure to) the platen frame 21 about the platen shaft 27 in a direction away from the subframe 22 (downward) is interposed. Each of the pressure-applying mechanisms 37 is formed of, for example, a coil spring extending in the vertical direction L1. A lower end portion of each of the pressure-applying mechanisms 37 is individually coupled to the subframe 22, whereas an upper end portion thereof is coupled to the coupling portion 25 of the platen frame 21.

As illustrated in FIG. 3 to FIG. 5, the head unit 3 includes a head block 38 including the thermal head 12 described above, the movable blade 11, and a head frame 41. The head frame 41 supports the head block 38 and the movable blade 11 in a removable manner.

The head frame 41 has a U-like shape in front view as viewed in the longitudinal direction L3. The head frame 41 includes a pair of side wall portions 42 and a top wall portion 43. The pair of side wall portions 42 located on both sides of the head frame 41 in the horizontal direction L2. The top wall portion 43 bridges upper end portions of the side wall portions 42. An engagement concave portion 44, with which corresponding one of the bearings 29 for the platen roller 10 is individually engaged, is formed on each of the side wall portions 42. The engagement concave portions 44 are open upward, and have a width along the longitudinal direction L3, which gradually decreases in a downward direction. Further, a stopper portion 45, which comes into engagement with the corresponding one of the bearings 29 for the platen roller 10 from above when the printer cover 6 is located at the closed position, is formed on an inner circumferential edge of the engagement concave portion 44 so as to project to the front.

As illustrated in FIG. 4 and FIG. 5, a guiding member 48 is provided at a portion located between the side wall portions 42 of the head frame 41. In a central portion of the guiding member 48 in the horizontal direction L2, a receiving portion 48*a* that is recessed downward is formed. The roller main body 28 of the platen roller 10 described above is received in the receiving portion 48*a* when the printer cover 6 is located at the closed position. The guiding member 48 is configured so that the recording sheet P passes between an outer circumferential surface of the roller main body 28 and a bottom surface of the receiving portion 48*a*.

As illustrated in FIG. 4, a platen driving gear 52 is provided on one of the side wall portions 42, which is located on the other end side in the horizontal direction L2. The platen driving gear 52 comes into meshing engagement with the platen gear 31 of the platen unit 2 when the platen unit 2 and the head unit 3 are combined with each other. The platen driving gear 52 is connected to a platen driving motor 53 (see FIG. 5) mounted in the head frame 41 through intermediation of a platen gear train mechanism (not shown). With this configuration, through appropriate rotation of the platen driving motor 53, a rotating force of the platen driving motor 53 is transmitted to the platen gear 31 through intermediation of the platen gear train mechanism and the platen driving gear 52. As a result, the platen roller 10 can be rotated.

Figure 6:
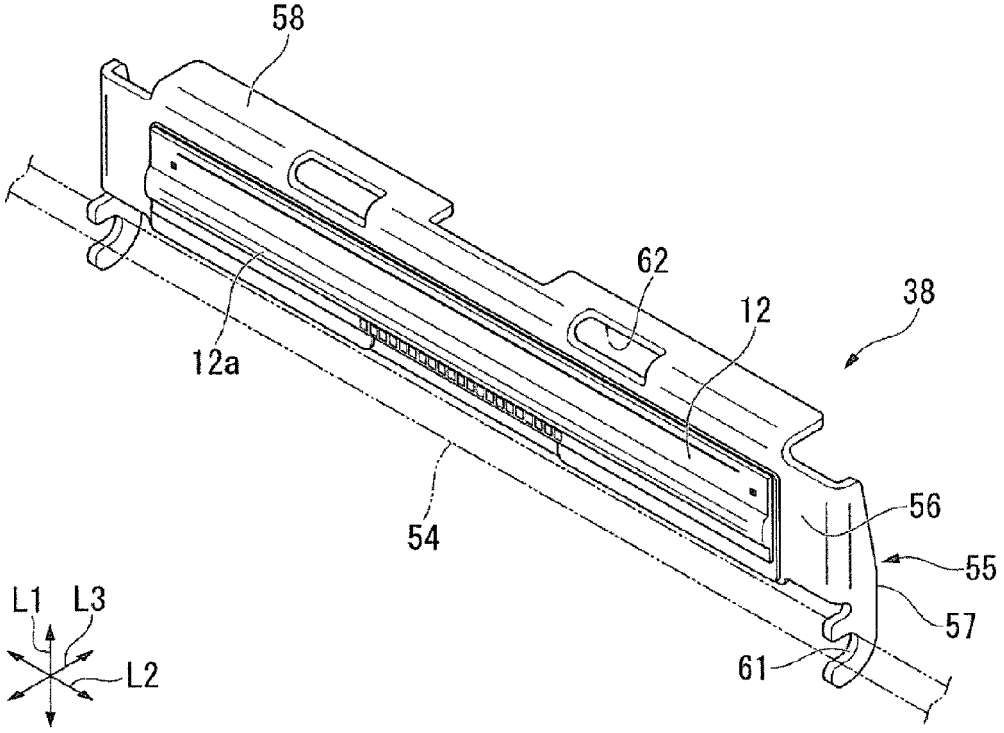
FIG. 6 is a perspective view of a head block according to the first embodiment.

FIG. 6 is a perspective view of the head block 38. As illustrated in FIG. 4 to FIG. 6, the head block 38 includes a head support 55 and the above-mentioned thermal head 12. The head support 55 is supported on a pivot shaft 54 provided in the head frame 41 so as to be pivotable about the pivot shaft 54. The thermal head 12 is fixed to the head support 55. The pivot shaft 54 is provided so as to extend along the horizontal direction L2, and both end portions of the pivot shaft 54 are individually supported by the side wall portions 42 of the head frame 41.

The head support 55 is formed by bending a plate member made of a metal or the like and is placed inside the head frame 41. Specifically, the head support 55 includes a head support wall 56, a pair of side wall portions 57, and an upper wall portion 58. The thermal head 12 is fixed to the head support wall 56. The pair of side wall portions 57 are formed by individually bending forward both end portions of the head support wall 56 in the horizontal direction L2. The upper wall portion 58 is formed by bending forward an upper end portion of the head support wall 56.

The head support wall 56 has a thickness direction in the longitudinal direction L3 and extends in the horizontal direction L2. An upper portion of the head support wall 56 is located above a bottom surface of the receiving portion 48*a* of the guide member 48.

Each of the side wall portions 57 has a width in the longitudinal direction L3, which gradually increases in a downward direction, and has a lower end portion located below the head support wall 56. In a lower end portion of each of the side wall portions 57, a receiving concave portion 61 for receiving the above-mentioned pivot shaft 54 therein is formed. The receiving concave portion 61 has a C-like shape in side view as viewed in the horizontal direction L2 and is open rearward (toward another end in the longitudinal direction L3). With the above-mentioned configuration, the head support 55 is pivotable about the pivot shaft 54 in the longitudinal direction L3 (in a direction toward and away from the platen roller 10) and is mounted to the pivot shaft 54 so as to be removable therefrom.

A pair of slits 62 passing through the upper wall portion 58 are formed in both end portions of the upper wall portion 58 in the horizontal direction L2. The slits 62 are formed across a corner portion formed by the upper wall portion 58 and the head support wall 56. A front end edge of each of the slits 62 terminates within the upper wall portion 58, whereas a rear end edge thereof terminates within the head support wall 56.

Further, as illustrated in FIG. 5, the head support 55 is urged rearward by a head urging member (spring member) 64 interposed between a support plate 63 provided so as to extend downward from the top wall portion 43 of the head frame 41 and the head support wall 56.

As illustrated in FIG. 4 and FIG. 6, the thermal head 12 is formed to have a plate-like shape extending along the horizontal direction L2 (sheet width direction of the recording sheet P), and is fixed onto the head support wall 56. On a surface of the thermal head 12, a plurality of heating elements 12*a* are arranged linearly. The heating elements 12*a* are located above a bottom surface of the receiving portion 48*a* of the guiding member 48, and are arranged so as to be opposed to the platen roller 10 when the printer cover 6 is located at the closed position.

As illustrated in FIG. 4 and FIG. 5, the movable blade 11 is placed on the top wall portion 43 of the head frame 41. When the printer cover 6 is located at the closed position, the movable blade 11 is opposed to the fixed blade 13 in the longitudinal direction L3. Specifically, the movable blade 11 includes a movable-blade frame 71, a movable-blade main body 72, and a driving mechanism 73. The movable-blade main body 72 is supported slidably by the movable-blade frame 71. The driving mechanism 73 drives the movable-blade main body 72.

The movable-blade frame 71 is formed by bending a metal or the like and placed on the top wall portion 43 of the head frame 41. The movable-blade frame 71 includes, for example, a fixing piece (not shown) formed thereon. The fixing piece is fixed to the head frame 41 by screwing or the like so as to be removable therefrom. As long as the movable-blade frame 71 is removable from the head frame 41, the fixing piece may be fixed to any of the top wall portion 43 and the side wall portions 42. Means for fixing the movable-blade frame 71 and the head frame 41 is not limited to the screwing. Fixing means without using a screw, such as locking with a claw, may be used as long as the movable-blade frame 71 can be fixed to the head frame 41.

Tongue-piece like lock portions 75 extending downward are formed on a rear end edge of the movable-blade frame 71. The lock portions 75 are formed in pair on the movable-blade frame 71 at positions equivalent to those of the above-mentioned slits 62 of the head support 55 in the horizontal direction L2 and are freely inserted into the corresponding slits 62 from above. In this case, the lock portions 75 abut against (are locked to) opening edges of the slits 62 on both ends in the longitudinal direction L3 along with the pivot of the head block 38 described above so as to restrict a further pivot of the head block 38. In other words, the pivot of the head block 38 is restricted within a width range of each of the slits 62 in the longitudinal direction L3.

Figure 7:
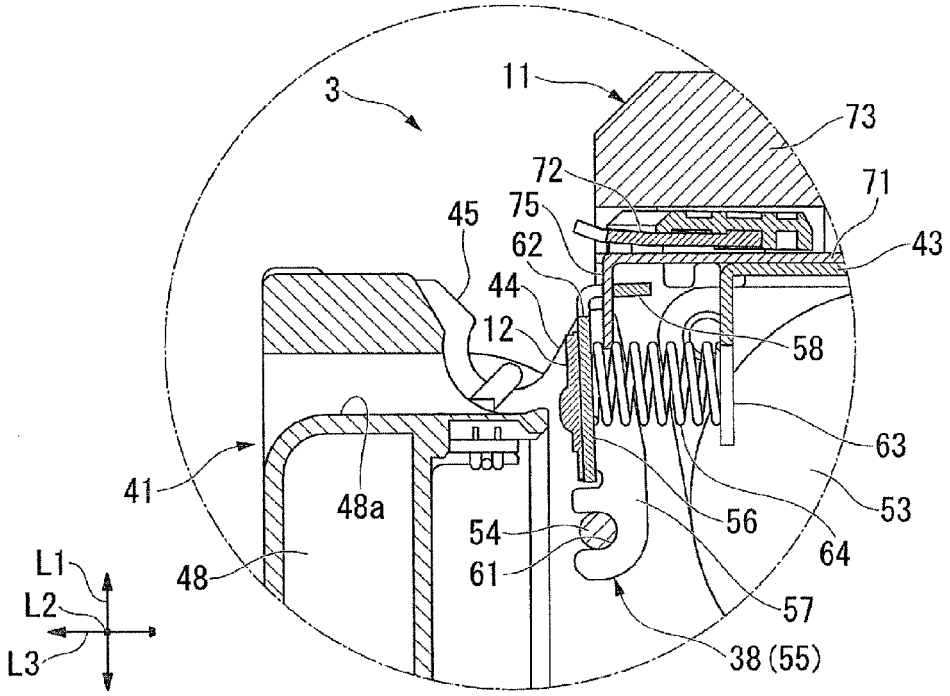
FIG. 7 is an explanatory diagram for illustrating an operation of mounting and removing the head block according to the first embodiment, which corresponds to a partial sectional view of a head unit.

For example, under a state in which the units 2 and 3 are separated away from each other (when the printer cover 6 is located at the opened position), the head block 38 is urged rearward by the head urging member 64 so that front-end opening edges of the slits 62 come into abutment against the lock portions 75 from the front side (see FIG. 7).

The movable-blade main body 72 is formed to have a V-like shape in plan view as viewed in the vertical direction L1 so that a length from a bottom to a blade tip of the movable-blade main body 72 gradually decreases from both ends toward the center. The driving mechanism 73 includes a cutter motor rotatable in a forward direction and a reverse direction, which is mounted onto the movable-blade frame 71, and a gear train mechanism connected between the cutter motor and the movable-blade main body 72. When a driving force of the cutter motor is transmitted to the movable-blade main body 72 through intermediation of the gear train mechanism, the movable-blade main body 72 is moved in a sliding manner.

A releasing lever 77 for releasing the combination of the platen unit 2 and the head unit 3 is provided to a portion of the above-mentioned pivot shaft 54, which is located on one end side in the horizontal direction L2 with respect to the side wall portion 42. The releasing lever 77 is formed to have a V-like shape in side view as viewed in the horizontal direction L2, and a corner portion of the releasing lever 77 is supported so as to be pivotable about the pivot shaft 54. A lever member (not shown) provided to the casing main body 5 is locked to a portion of the releasing lever 77, which is located on one end side with respect to the corner portion. A portion of the releasing lever 77, which is located on another end side, comes into abutment against the above-mentioned projecting piece 26 of the platen frame 21 from below. In this manner, the releasing lever 77 pivots in conjunction with the operation of the lever member to push up the platen unit 2 through intermediation of the projecting piece 26, thereby separating the platen unit 2 from the head unit 3.

In the thermal printer 1 configured as described above, under a state in which the printer cover 6 is located at the closed position and the units 2 and 3 are combined with each other, the movable blade 11 partially overlaps the fixed blade 13 with an appropriate contact pressure, and the recording sheet P is nipped between the platen roller 10 and the thermal head 12. After passing between the movable blade 11 and the fixed blade 13, the recording sheet P is pulled out of the casing 4 through the discharge port 8. Further, the platen gear 31 of the platen unit 2 comes into meshing engagement with the platen driving gear 52 provided to the head unit 3.

Thereafter, the platen driving motor 53 is driven so that the rotating force of the platen driving motor 53 is transmitted to the platen gear 31 of the platen unit 2. As a result, the platen roller 10 can be rotated so that the recording sheet P can be fed while the recording sheet P is nipped between the platen roller 10 and the thermal head 12. Simultaneously with the sheet feeding, various letters and figures can be clearly printed on the recording sheet P that is being fed, by appropriately allowing the heating elements 12*a* of the thermal head 12 to generate heat.

The printed recording sheet P passes between the fixed blade 13 and the movable blade 11. Then, after the passage of the recording sheet P by a predetermined length, the driving mechanism 73 is driven to slide the movable-blade main body 72 toward the fixed blade 13. In this manner, the recording sheet P can be cut between the fixed blade 13 and the movable blade 11. As a result, the recording sheet P thus cut can be used as a receipt or a ticket.

Next, actuation of the above-mentioned thermal printer 1 is described. FIG. 7 to FIG. 11 are explanatory diagrams for illustrating an operation of mounting and removing the head block 38, which correspond to partial sectional views of the head unit 3. In the following description, an operation of removing the head block 38 after the separation of the units 2 and 3 from each other is mainly described. First, the printer cover 6 is located at the opened position. Specifically, when the lever member (not shown) provided to the casing main body 5 is operated, the releasing lever 77 pivots about the pivot shaft 54 in conjunction with the operation of the lever member. Then, the releasing lever 77 pushes up the platen unit 2 through intermediation of the projecting piece 26.

Then, the platen roller 10 is detached from the engagement concave portions 44 while an outer circumferential surface of the roller main body 28 is pushing the head block 38 in a direction against the urging forces of the head urging member 64. Then, the bearings 29 of the platen roller 10 climb over the stopper portions 45, thereby disengaging the bearings 29 and the stopper portions 45 from each other. As a result, the combination of the units 2 and 3 is released as illustrated in FIG. 7. Thereafter, as illustrated in FIG. 1, the printer cover 6 is pulled up to bring the printer cover 6 into the opened position. When the combination of the units 2 and 3 is released as illustrated in FIG. 7, the head block 38 pivots rearward by the urging forces of the head urging member 64. Thereafter, the front-end opening edges of the slits 62 come into contact with the lock portions 75 from the front side, thereby positioning the head block 38 with respect to the head frame 41.

Figure 8:
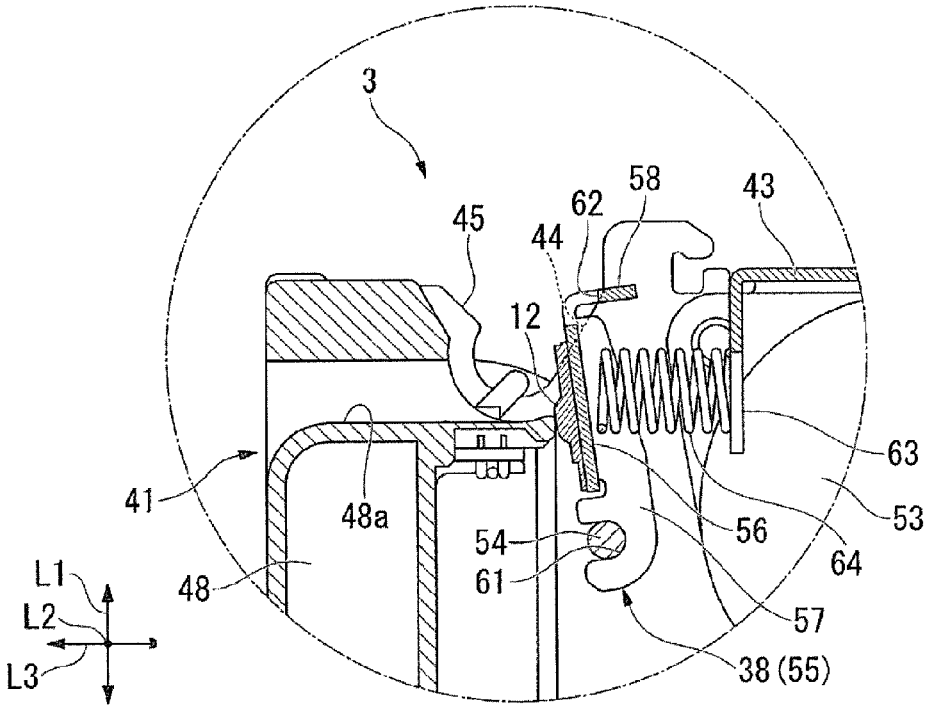
FIG. 8 is an explanatory diagram for illustrating the operation of mounting and removing the head block according to the first embodiment, which corresponds to a partial sectional view of the head unit.

Next, for removing the head block 38 from the head unit 3, the movable blade 11 is first removed from the head unit 3, as illustrated in FIG. 8. Specifically, after the movable-blade frame 71 and the head frame 41 are unfastened, the movable blade 11 is pulled up. Then, the lock portions 75 of the movable blade 11 retract from the slits 62 of the head block 38 to cancel the restriction of the head block 38 by the lock portions 75. As a result, the head block 38 pivots rearward about the pivot shaft 54 by the urging forces of the head urging member 64. In the example illustrated in FIG. 8, the head support 55 (head support wall 56) separates away from the head urging member 64, and hence the thermal head 12 comes into contact with the guide member 48 from the front side. As a result, a further pivot of the head block 38 is restricted.

Figure 9:
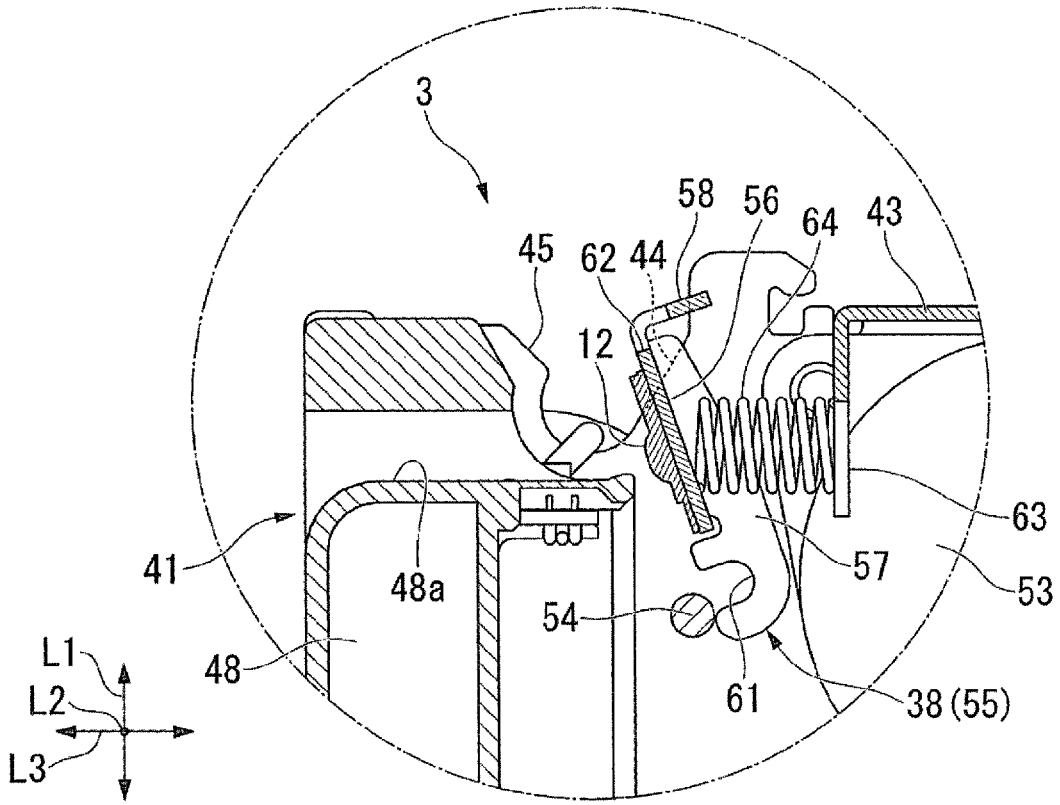
FIG. 9 is an explanatory diagram for illustrating the operation of mounting and removing the head block according to the first embodiment, which corresponds to a partial sectional view of the head unit.

Next, as illustrated in FIG. 9, the head block 38 (head support 55) and the pivot shaft 54 are decoupled from each other. Specifically, the head block 38 is moved forward with respect to the head frame 41 to detach the pivot shaft 54 from the receiving concave portions 61.

Figure 10:
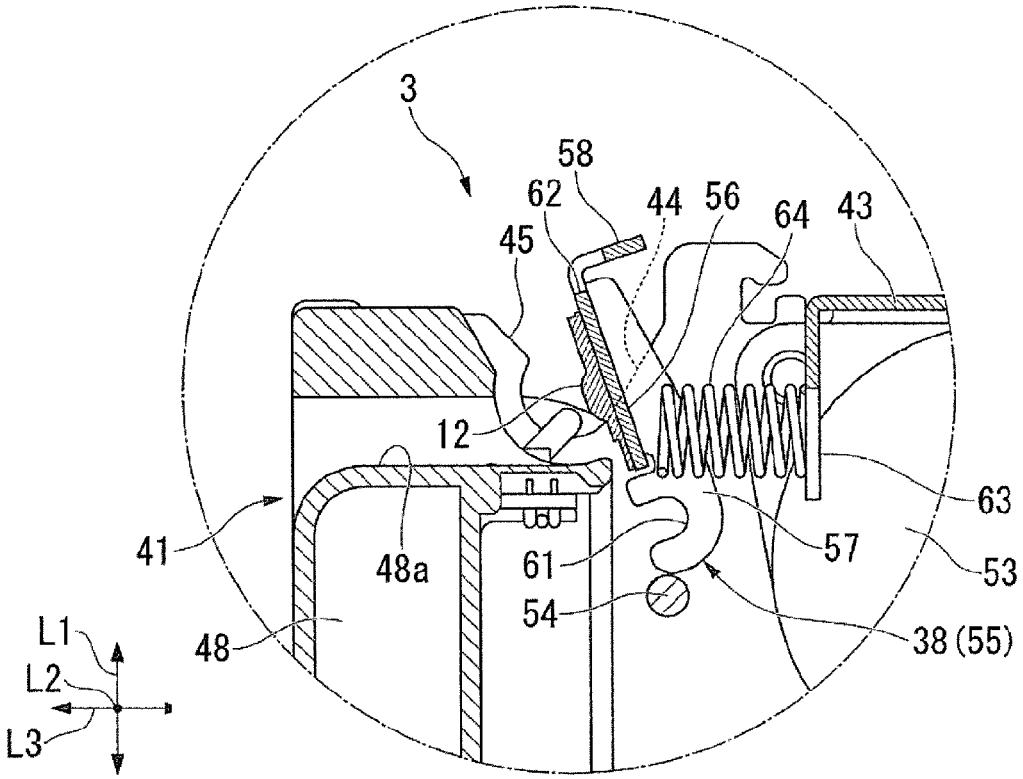
FIG. 10 is an explanatory diagram for illustrating the operation of mounting and removing the head block according to the first embodiment, which corresponds to a partial sectional view of the head unit.
Figure 11:
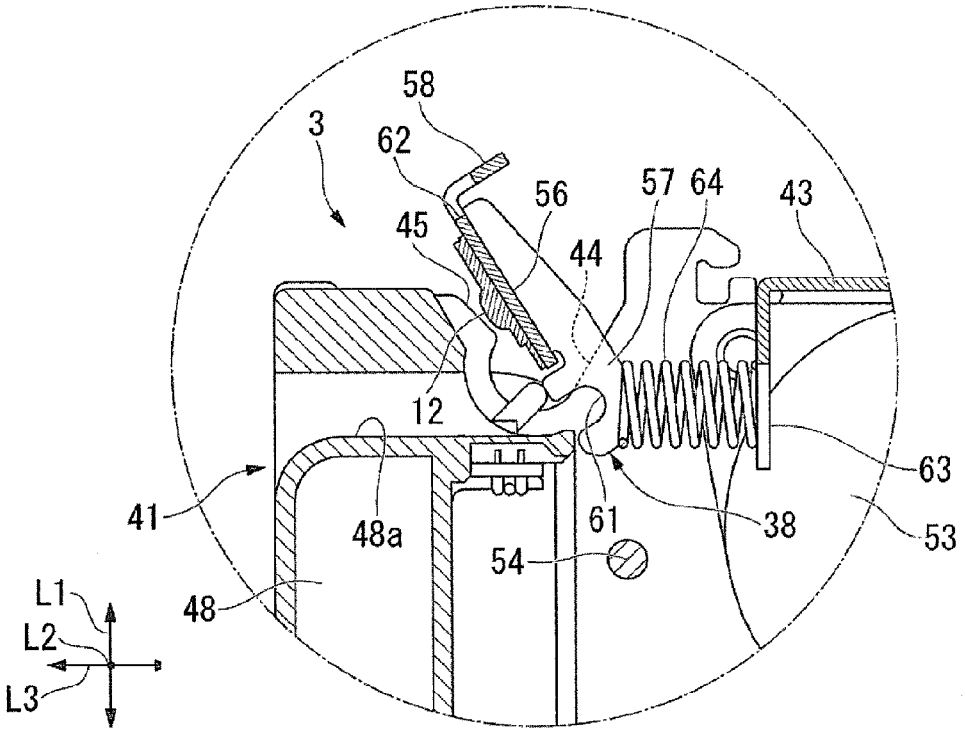
FIG. 11 is an explanatory diagram for illustrating the operation of mounting and removing the head block according to the first embodiment, which corresponds to a partial sectional view of the head unit.

Next, as illustrated in FIG. 10, the head block 38 is pulled up and rearward. Then, the head block 38 is pulled out of the head frame 41 through a gap between the guide member 48 and the top wall portion 43 of the head frame 41. Through the operation described above, the head block 38 is removed from the head unit 3.

For mounting a new head block 38 onto the head unit 3, the reverse of the above-mentioned removing operation is performed. Specifically, after the head block 38 is inserted into the head frame 41 through the gap between the guide member 48 and the top wall portion 43 of the head frame 41, the receiving concave portions 61 of the head support 55 and the pivot shaft 54 are coupled to each other. Next, the movable blade 11 is fixed to the head frame 41 so that the lock portions 75 of the movable blade 11 are freely inserted into the slits 62 of the head support 55. Through the operation described above, the head block 38 can be replaced.

As described above, in this embodiment, the lock portions 75 for restricting the pivot of the head block 38 are formed on the movable blade 11 that is arranged so as to be removable from the head frame 41. According to this configuration, the restriction of the rearward pivot of the head block 38 by the lock portions 75 can be cancelled through the removal of the movable blade 11 from the head frame 41. Therefore, for the work of replacing the head block 38, the head block 38 can be pulled out rearward. In this case, the space for replacement of the head block 38, which is set in the head frame 41 on the front side with respect to the head block 38, can be minimized. Therefore, the degree of freedom in design inside the head frame 41 can be improved in that, for example, a component can be arranged in the space on the front side with respect to the head block 38. Therefore, a product can be downsized.

Further, in this embodiment, the work of replacing the head block 38 can be performed only by removing the movable blade 11 that is removable from the head frame 41. Therefore, efficiency of the replacement work is enhanced at reduced costs. In addition, the locking portions 75 are formed on the existing movable blade 11 (movable-blade frame 71). Therefore, the increase in number of components due to the formation of the lock portions 75 can be prevented.

Further, in this embodiment, the receiving concave portions 61 for receiving the pivot shaft 54 of the head frame 41, which are open rearward, are formed in the head block 38. According to this configuration, in contrast to the case where, for example, the pivot shaft 54 is inserted into through holes of the head block 38, the head block 38 and the pivot shaft 54 can be easily decoupled from each other only by moving the head block 38 in a direction in which the pivot shaft 54 is detached from the receiving concave portions 61. As a result, the operability can be further improved.

In addition, in this embodiment, the lock portions 75 are provided so as to extend along the direction in which the movable blade 11 is mounted and removed (vertical direction L1). Therefore, along with the operation of mounting and removing the movable blade 11, the state of the lock portions 75 and the head block 38 is switched between the locked state and the unlocked state. Therefore, the operability can be further improved.

In addition, in the thermal printer 1 of this embodiment, the printer includes the above-mentioned printing unit 9. Therefore, excellent operability can be provided, while the downsizing and the improvement of the degree of freedom in design are achieved.

Note that, the technical scope of the present invention is not limited to the above-mentioned embodiment, but various modifications can be made without departing from the gist of the present invention.

For example, in the embodiment described above, the fixed blade 13 is provided to the platen frame 21, whereas the movable blade 11 is provided to the head frame 41. However, the configuration is not limited thereto. Specifically, the movable blade 11 may be provided to the platen frame 21, whereas the fixed blade 13 may be provided to the head frame 41.

Further, in the embodiment described above, the slits 62 are formed in the upper wall portion 58 of the head support 55, and the lock portions 75 are freely inserted into the slits 62. However, positions on the head block 38, at which the lock portions 75 are locked, can be appropriately changed in design. For example, the lock portions 75 may be locked to the side wall portions 57 of the head support 55. Further, the slits 62 are not required to be formed as long as the lock portions 75 are locked to the head block 38.

Further, in the embodiment described above, the receiving concave portions 61 are open rearward. However, the configuration is not limited thereto. For example, the pivot shaft 54 may be inserted into through holes formed in the head support 55.

Second Embodiment

Next, a second embodiment of the present invention is described with reference to FIG. 12 and FIG. 13. The same members as those of the first embodiment described above are represented by the same reference symbols, and description thereof is omitted. Although the same members as those of the first embodiment described above are not illustrated in the second embodiment in order to describe differences from the first embodiment in an easy-to-understand manner, it is apparent that the same members are provided in the second embodiment.

Figure 12:
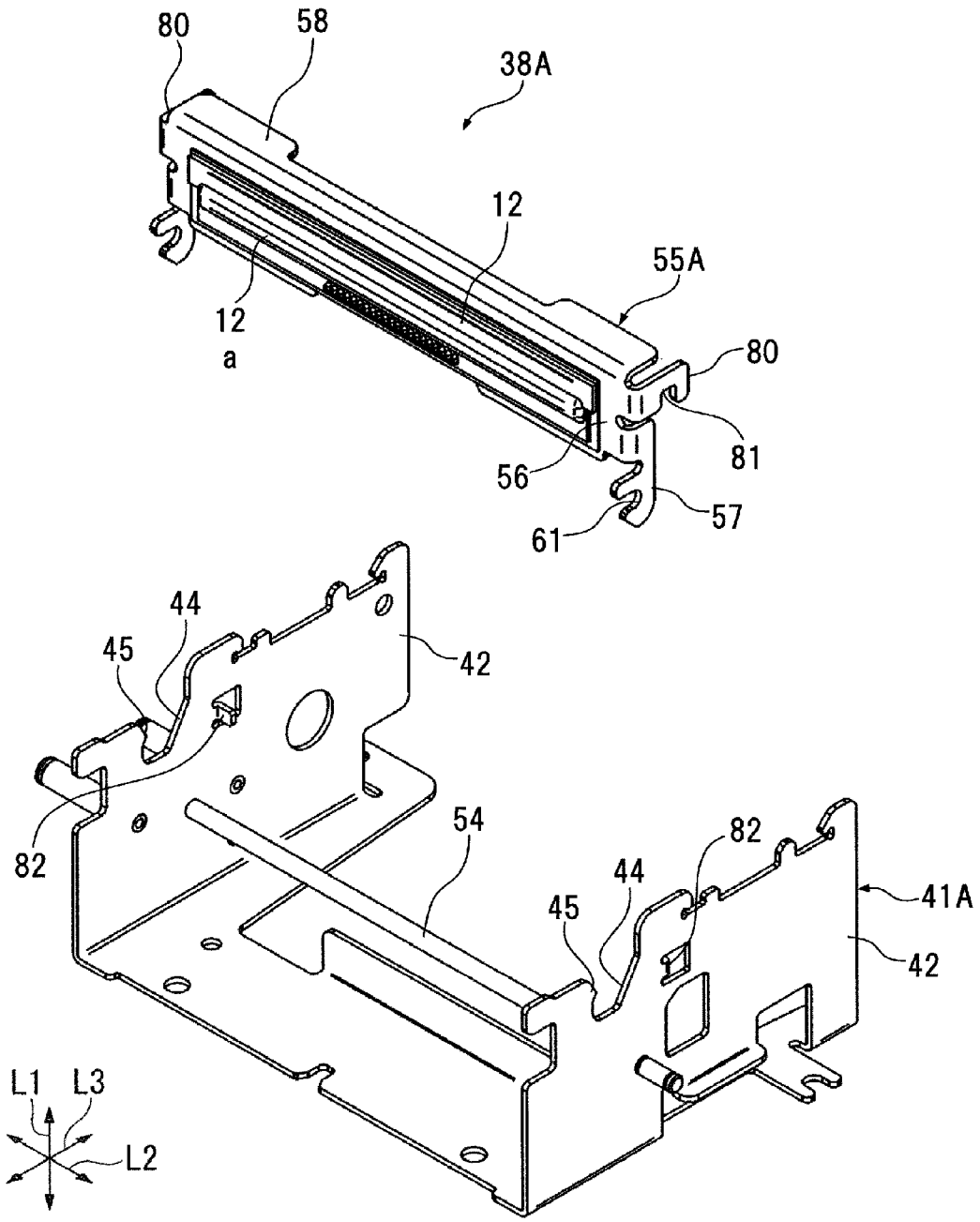
FIG. 12 is an exploded perspective view for illustrating a head block and a head unit according to a second embodiment of the present invention.
Figure 13:
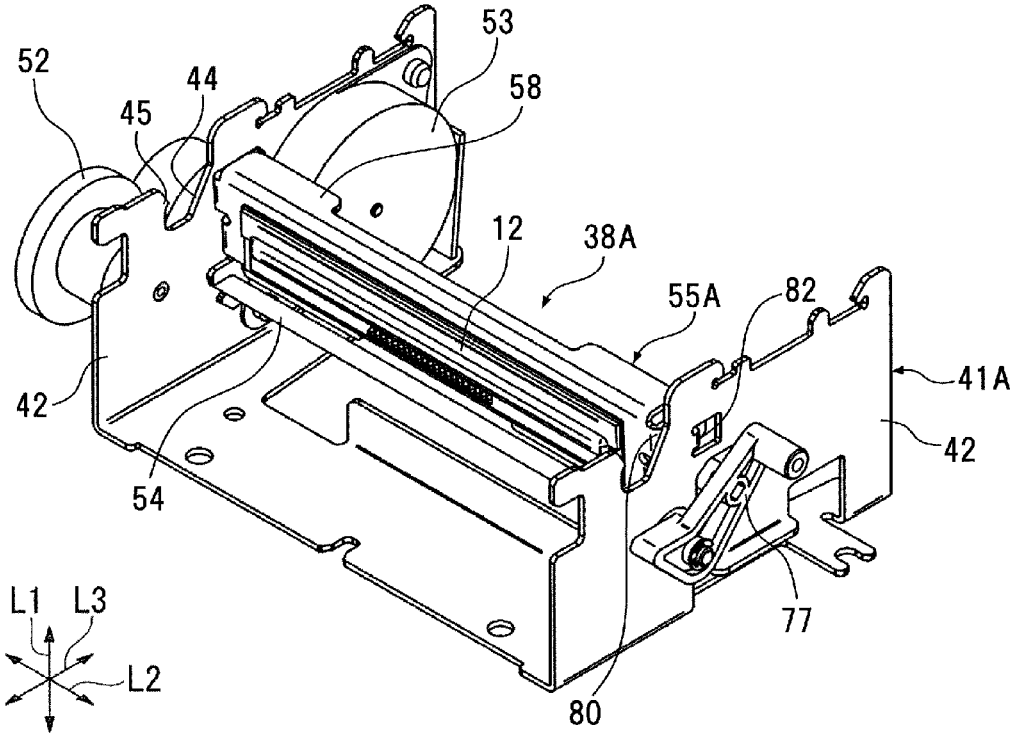
FIG. 13 is a perspective view for illustrating a state in which the head block illustrated in FIG. 12 is mounted onto the head unit.

FIG. 12 is an exploded perspective view of a head block 38A and a head frame 41A according to the second embodiment. FIG. 13 is a perspective view for illustrating a state in which the head block 38A illustrated in FIG. 12 is mounted inside the head frame 41A.

The head block 38A includes a head support 55A and the thermal head 12 described above. The head support 55A is supported on the pivot shaft 54 provided to the head frame 41A so as to be pivotable about the pivot shaft 54. The thermal head 12 is fixed to the head support 55A. The pivot shaft 54 is provided so as to extend along the horizontal direction L2, and both end portions of the pivot shaft 54 are individually supported by the side wall portions 42 of the head frame 41A.

The head support 55A includes the pair of side wall portions 57 and a pair of engagement arm portions 80. The side wall portions 57 are formed by individually bending forward lower portions of both ends of the head support wall 56 in the horizontal direction L2. The engagement arm portions 80 are formed by individually bending forward upper portions of the both ends of the head support wall 56 in the horizontal direction L2.

In a central portion of each of the engagement arm portions 80 in the longitudinal direction L3, an engagement concave portion 81 that is open downward is formed. Specifically, each of the engagement arm portions 80 is formed to have an inverted U-like shape as viewed in the horizontal direction L2.

Further, lock portions 82 projecting from inner surfaces of the side wall portions 42 are formed respectively at positions on the side wall portions 42 of the head frame 41A, which correspond to the engagement concave portions 81 of the engagement arm portions 80 at the time when the head frame 41A is mounted. Each of the lock portions 82 is formed as follows. A tongue piece portion is formed by cutting sides of a rectangular region except for a rear side at the corresponding position on each of the side wall portions 42. The thus formed tongue piece portion is bent inward at a right angle with respect to the head frame 41A, thereby forming the lock portion 82.

Then, the lock portions 82 are freely inserted into the engagement concave portions 81 formed in the engagement arm portions 80 of the head support 55A described above. In this case, the lock portions 82 come into abutment against (are locked to) opening edges of the engagement concave portions 81 at both ends in the longitudinal direction L3 along with the pivot of the head block 38 described above, to thereby restrict a further pivot of the head block 38A. In other words, a pivot of the head block 38A is restricted within a width range of the each of the engagement concave portions 81 in the longitudinal direction L3.

For example, under a state in which the units 2 and 3 are separated away from each other (when the printer cover 6 is located at the opened position), the head block 38A is urged rearward by the head urging member 64. As a result, the front-side opening edges of the engagement concave portions 81 come into abutment against the lock portions 82 from the front side.

Next, an operation of mounting and removing the head block 38A according to the second embodiment is described. The operation of mounting and removing the head block 38A is basically the same as the operation of mounting and removing the head block 38 according to the first embodiment described above, and therefore differences from the first embodiment are mainly described below.

For removing the head block 38A from the head frame 41A of the head unit 3, the movable blade 11 is first removed from the head unit 3 (head frame 41A). Next, the head block 38A is moved forward with respect to the head frame 41A to detach the pivot shaft 54 from the receiving concave portions 61, thereby decoupling the head block 38A and the pivot shaft 54 from each other.

Next, the head block 38 is pulled up into an open space above the head block 38A, which is generated by removing the movable blade 11 from the head frame 41A, to disengage the engagement concave portions 81 of the head block 38A and the lock portions 82 of the head frame 41A from each other. Further, when the head block 38A is pulled up and rearward, the head block 38A is pulled out of the head frame 41 through the gap between the guide member 48 and the top wall portion 43 of the head frame 41A. Through the operation described above, the head block 38A is removed from the head frame 41A.

As described above, in the second embodiment, the lock portions 82 for restricting the pivot of the head block 38A toward the platen roller 10 are formed on the head frame 41A. As in the case of the first embodiment described above, the head block 38A can be removed from the head frame 41A after the movable blade (cutter mechanism) 11 is removed from the head frame 41A.

With the configuration described above, as in the first embodiment described above, when the movable blade 11 is removed from the head frame 41A and the lock portions 82 and the head block 38A are disengaged from each other, the restriction of the pivot of the head block toward the platen roller is cancelled. Therefore, for work of replacing the head block 38A, the head block 38A can be pulled out rearward.

Besides the above, the components in the above-mentioned embodiments may be replaced by well-known components as appropriate without departing from the gist of the present invention. The above-mentioned modified examples may be combined with each other as appropriate.

What is claimed is:

1. A printing unit, comprising:

a head unit including a head block having a thermal head provided therein;

a platen unit including a platen roller configured to feed a recording sheet, the platen unit being separably combined with the head unit, wherein the head unit includes:

a head frame including the head block removably mounted thereon, the head frame being configured to support the head block so that the head block is pivotable in a direction approaching and separating from the platen roller;

an urging member interposed between the head frame and the head block, the urging member being configured to urge the thermal head toward the platen roller;

a cutter mechanism mounted onto the head frame so as to be removable therefrom; and lock portions locked to the head block, which are configured to restrict a pivot of the head block toward the platen roller.

2. The printing unit according to claim 1, wherein the lock portions are provided to the cutter mechanism.

3. The printing unit according to claim 2, wherein the lock portions are provided so as to extend in a direction in which the cutter mechanism is mounted and removed, and the head block includes slits into which the lock portions are freely inserted along the direction in which the cutter mechanism is mounted and removed.

4. The printing unit according to claim 1, wherein the lock portions are provided to the head frame.

5. The printing unit according to claim 4, wherein the lock portions are freely inserted into engagement concave portions formed in the head block.

6. The printing unit according to claim 1, wherein the head block is configured to be pulled out toward the platen roller to be removed under a state in which the cutter mechanism is removed from the head frame.

7. The printing unit according to claim 1, wherein the head block includes receiving concave portions being open toward the platen roller, which are configured to receive a pivot shaft of the head frame therein.

8. A printer comprising the printing unit according to claim 1, wherein the head unit is mounted to a casing main body including a recording-sheet receiving portion configured to receive the recording sheet, and the platen unit is mounted to a printer cover to be pivotably coupled to the casing main body through intermediation of a hinge portion, the printer cover being configured to open and close the recording-sheet receiving portion.

* * * * *